United States Patent [19]

Bonkowski

[11] Patent Number: 4,688,367

[45] Date of Patent: Aug. 25, 1987

[54] HEAT PRINTED CARRIER AND METHOD

[76] Inventor: Lorne Bonkowski, 8302 Encino Ave., Stockton, Calif. 95209

[21] Appl. No.: 837,665

[22] Filed: Mar. 4, 1986

Related U.S. Application Data

[63] Continuation of Ser. No. 601,979, Apr. 19, 1984, abandoned.

[51] Int. Cl.[4] ..... B65B 21/00

[52] U.S. Cl. ..... 53/398; 53/453; 53/48; 53/559

[58] Field of Search ..... 53/398, 441, 453, 464, 53/468, 556, 48, 478, 487, 141

[56] References Cited

U.S. PATENT DOCUMENTS

| | | | |
|---|---|---|---|
| 2,210,509 | 8/1940 | Strauch | 53/464 |
| 2,301,106 | 11/1942 | Brown | 53/464 |
| 2,622,380 | 12/1952 | Snyder | 53/464 |
| 2,958,172 | 11/1960 | Branche | 53/509 X |
| 2,989,827 | 6/1961 | Groth | 53/427 |
| 3,488,911 | 1/1970 | Poupitch | 53/441 X |
| 3,494,098 | 2/1970 | Sternau | 53/488 X |
| 3,946,535 | 3/1976 | Bourgeois | 53/398 |
| 3,962,844 | 6/1976 | Gordon | 53/488 X |
| 4,184,310 | 1/1980 | Shelby | 53/488 X |
| 4,281,502 | 8/1981 | Bonkowski | 53/398 |
| 4,305,499 | 12/1981 | Mercer | 53/441 X |

FOREIGN PATENT DOCUMENTS

| | | | |
|---|---|---|---|
| 132856 | 7/1977 | Fed. Rep. of Germany | 53/488 |

*Primary Examiner*—John Sipos

*Attorney, Agent, or Firm*—Spensley Horn Jubas & Lubitz

[57] ABSTRACT

The invention provides a cover for one or more articles, the cover being easily applied to each article by softening a portion of a sheet then forcing the non-softened portion around the article to cause the softened portion to stretch and conform to the article, providing a closely fitting cover. The shape of the softened area can be different than the shape of the article; various advantages are indicated for different configurations. A machine, a method, and the cover itself are all disclosed.

15 Claims, 7 Drawing Figures

HEAT PRINTED CARRIER AND METHOD

The present application is a continuation application of application Ser. No. 601,979, filed Apr. 19, 1984, abandoned.

BACKGROUND OF THE INVENTION

1. Field of the Invention

This invention relates to the covering or sealing of one or more articles, and especially to multi-pack carriers for an array of containers, such as the common six-pack beverage can container.

2. Prior Art

It is well known to connect an array of articles by means of a plastic carrier in order to package them as a single unit. There are many packages of this general type, representative carriers and packaging machines being disclosed by Poupitch in U.S. Pat. Nos. 2,874,835, 2,929,181 and 2,936,070, by Hall et al. in U.S. Pat. No. 3,032,944, by Fisher in U.S. Pat. No. 3,044,230, by Dreyfus in U.S. Pat. No. 3,744,626, by Curry et al. in U.S. Pat. Nos. 3,134,485 and 3,206,019, and by Bonkowski in U.S. Pat. No. 4,281,502. In addition, carriers which incorporate a cover of some type over the containers are disclosed by Harrison in U.S. Pat. No. 3,046,711, by Rapata in U.S. Pat. No. 3,200,944, by Poupitch in U.S. Pat. No. 3,355,013, by Hatfield in U.S. Pat. No. 3,871,699, and by Curry et al. in U.S. Pat. No. 4,116,331. Most of these carriers include either a first carrier layer, and a second cover layer or require the presence of a bead on the rims of the containers, or both.

As the foregoing patents evidence, simple and effective seals and carriers for containers have long been sought. Today, such seals or closures often take the form of a cap threaded about the top of the container, or crimped about the rim of the container. To prevent tampering with the contents, often such containers include one or more additional seals such as an adhesively secured disc beneath the cap and covering the mouth of the container. In high volume packaging applications, such caps must be applied at a rapid rate, and such seals also must be applied at a rapid rate. The machinery for doing this is complex, expensive, and requires constant and substantial maintenance to function properly. Also, such closures represent a significant portion of the total cost of the package.

Often containers are packaged in arrays and held together by various forms of carriers, one of which is the common 6-pack carrier, a stretchable plastic sheet with six openings for receiving the tops of the containers and engaging the underside of the rim about the tops to hold the containers in an array. Such carriers also are difficult to apply, and require expensive machinery that needs constant attention to function properly. Further, the carriers, when used and discarded, represent a significant threat both to the environment and to wildlife. Also, such carriers fail to seal or otherwise cover the tops of the containers and thus permit their contamination. There is a growing need and desire for such carriers that are easily applied by simple machinery, that are inexpensive, and that also cover and seal the top portions of the containers in the array.

It is an object of the present invention to provide a simple one-piece closely fitting cover or sealant for an article. The pharmaceutical industry is an example of one area in which manufacturers have become aware of the need for providing a simple, economical means of effectively sealing their products in order to prevent outside tampering. As instances of tampering become more widespread, other manufacturers who package products for human consumption will also require a simple method for sealing their products. The present invention provides such a method.

It is another object of the present invention to provide a carrier which does not require a bead or ridge of any type on the rim of the article in order to securely hold the container, permitting the carrier to be used with a wide variety of container types and styles.

It is a further object of the present invention to provide a method of creating a carrier or seal which does not require the heating and forming processes for the covering material to be conducted in proximity to the articles to be covered.

It is also an object of the present invention to provide a simple, economical method for creating pull-top or tamper-proof type seals for articles, by varying the shape of the portion of covering material heated to a configuration which does not necessarily correspond to the shape of the article to be covered.

It is also an object of the present invention to provide a method of creating a carrier or seal which does not require a forming device with an aperture the same shape as the article to be covered, and which readily lends itself to high volume applications.

In addition, the present invention provides a cover for one or more articles that can incorporate thin and thick areas, or patterned areas, over or adjacent each covered article for various purposes, such as to expedite removal of the cover, or to provide decoration, or to readily fracture if the cover is disturbed.

SUMMARY OF THE INVENTION

These and other objects are accomplished using a sheet of material which is stretchable upon softening but otherwise relatively rigid. To form a carrier, a sheet of such material is placed near or upon a heated platen or anvil. The heat transferred to the sheet will soften the area in contact or near proximity to the heated platen to permit the subsequent stretching and forming of this area. After a portion of the sheet has been softened in appropriate areas, the sheet is transferred to a position adjacent to a device for stretch forming the sheet. Whether the sheet is first placed near the forming device or first placed adjacent the article to be covered is not important. The forming device next causes the softened portion of the sheet, along with any non-softened areas bordering the softened portion, to be drawn and stretched over and around the surface of the container or package intended to be covered or held. The forming device has an opening to accommodate the articles to be covered, but this opening does not necessarily need to correspond to, or even resemble, the shape of the top of the container to be covered. As an example, an elliptically shaped opening in a forming device might be used to form a seal over a round object. The softened portion of the sheet then is allowed to cool to its unsoftened, relatively rigid state, resulting in a carrier that covers the top and sides of each article, thereby forming an effective cover and carrier.

BRIEF DESCRIPTION OF THE DRAWINGS

The invention will be further described in connection with the accompanying drawings in which.

DESCRIPTION OF THE PREFERRED EMBODIMENTS

The present invention may be used to cover, seal, hold or protect a single article. It may also be employed to interconnect a series of articles. The method disclosed allows the sealing or covering process to be broken down into several distinct steps. There is no requirement that the heating and forming processes be performed in an area adjacent to the articles to be covered, or that any particular type of covering material be used—it only need be capable of being softened by heat, chemical, or other softening means, and of being restiffened upon recooling or other conditions. Many different types of carriers or seals may be formed by varying the shape of the heat imprinted portion of the covering material. The embodiments of the carrier herein set forth are merely illustrative of the invention and the principles it employs. While it is described in many of the embodiments as being applied to a series of containers, such as beverage containers, it may be applied to any of a wide variety of other articles, and for any of various applications or purposes, only some of which are mentioned herein.

The present invention differs from the carriers and methods disclosed in the aforementioned patents in several significant respects. For example, when compared with the Bonkowski patent, supra, the present invention can employ a contact heating method rather than being limited to radiant heat through a patterned insulating plate. Thus, in the new method and machine, the insulating plate is done away with; the softening of the plastic covering material is accomplished by imprinting a heat pattern directly onto the plastic itself. Further, the new method does not require that the heating process take place at a location immediately adjacent the article to be covered; the softening process may take place at a location substantially separated from the forming process. One of the most important differences between the present invention and the approach set forth in the Bonkowski patent, supra, is that the forming plate need not correspond in absolute or even relative shape to the portion of the article to be covered. Likewise, the shape of the softened area need not conform in shape or size to the top of the article to be covered. By varying the shape of the heat imprinted area, it is possible to create, for example, tabs or other easy-open type seals. These two improvements serve to significantly simplify the covering process and the machine required to do such covering. For instance, with only a slight modification to the heat patterning elements, the same machine could be used to create covers as various as: tamper-evident seals with pull tabs, inner cap seals, carriers, shipping packages or display packages.

Figure 1:
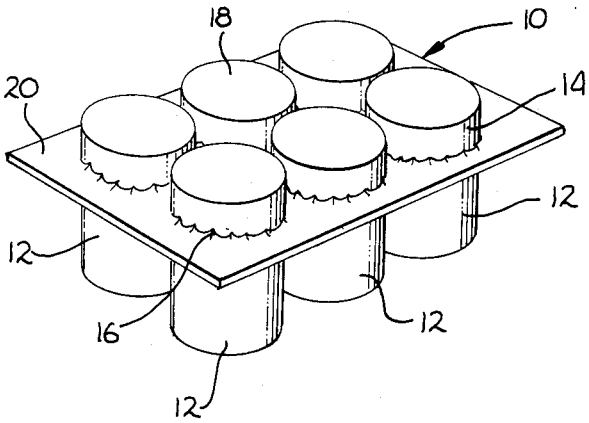
FIG. 1 is a perspective view of an array of containers interconnected by a carrier formed in accordance with the present invention.

Referring to FIG. 1, a carrier 10 is shown interconnecting an array of six containers 12. The carrier 10 includes a side portion 14 which surrounds the upper part of the wall of each container 12 in the array. Each side portion 14 may consist of a ridged a serrated area 16 at its base, and a cover portion 18 located over the top of each container 12. A skirt portion 20 extends from the bottom of the side portions 14, the common skirt portion interconnecting the containers 12 and providing a carrier for the array.

Figure 2:
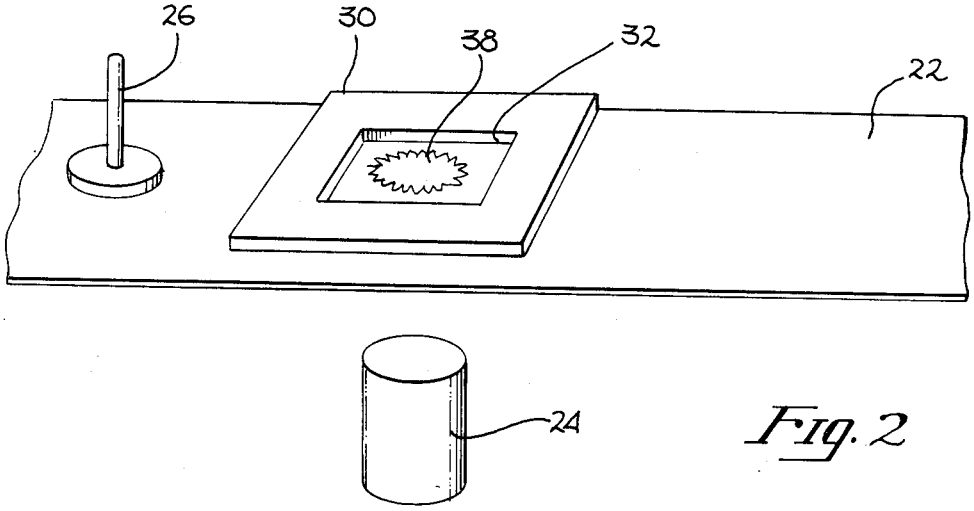
FIG. 2 is a perspective view of a container showing a plastic sheet positioned above the container, with the portion of the sheet to be pulled over the top of the container in a softened state, and a forming plate having a different shape than that of the container to be covered positioned over the plastic sheet.
Figure 3:
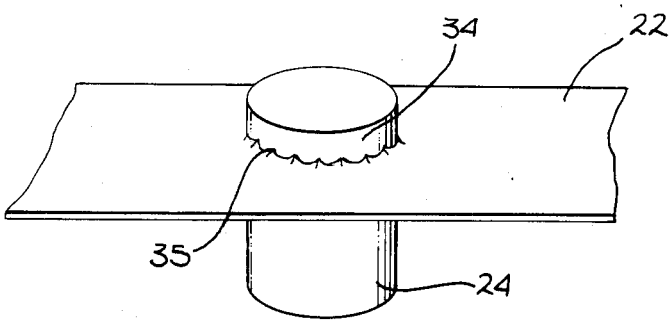
FIG. 3 is a perspective view of a covered container in which the heated portion of the plastic was a different shape than the top of the container to be covered.

FIGS. 2 and 3 illustrate a preferred method for sealing a single article. The disclosed method and invention are equally well suited to covering an array of articles. As shown in FIG. 2, a sheet of material 22 is positioned over the article 24 to be covered. This sheet may be of any material that can be softened, such as upon application of heat, and can then be returned to a relatively stiff or rigid condition, such as upon cooling. For example, a thermosensitive plastic, such a polyethylene, may be used to form the sheet. The following examples assume use of such a thermosensitive material. Other materials likely will require a somewhat different approach, yet may proceed in accordance with the teachings set forth herein.

A heated platen 26 is used to soften a selected portion of the material 22. This softened area may or may not conform to the shape of the top of the article 24 to be covered, depending on the desired configuration of the resultant cover. The softened portion 28 is then positioned over the article 24 to be covered. Located above the covering material 22 is a forming plate 30 which has an opening 32 in its middle. This opening also need not conform to the shape of the top of the article 24 to be covered or even to the shape of the softened area; a square opening is shown for illustrative purposes. The opening 32 of the illustrated embodiment is substantially larger than the softened portion 28 or the top of the article 24 to be covered. When the exposed portion of the sheet 22 has been softened to an extent adequate to render it reasonably pliable or stretchable, the forming plate 30 is then lowered to move the sheet down over the top of article 24 and form the material 22 over the top of the article 24. As the forming plate 30 moves downward, it engages the nonsoftened portion of the sheet 22, which causes the softened portion 28 of the material to stretch and form around the top of the article 24. The forming plate 30 is then lifted and removed.

By these simple steps, and as shown in FIG. 3, sheet 22 has been formed into a seal or cap which covers the top of the article 24 and a portion of its side 34. Due to the serrated or irregular margin of circular heated portion 28, resulting from the pattern of heat applied by platen 26, the cover contains a ridged portion 35 around the sides of the article 24. Such a portion can, for example, assist in holding the article to sheet 22. After forming the sheet 22 over the top of the article 24, the sheet 22 is allowed to cool thereby returning the heated portion 28 to its previously stiff or rigid state. When the sheet 22 has returned to its original unsoftened state, the process is completed and an effective one piece carrier or cover is provided in a simple, effective manner.

Figure 4B:
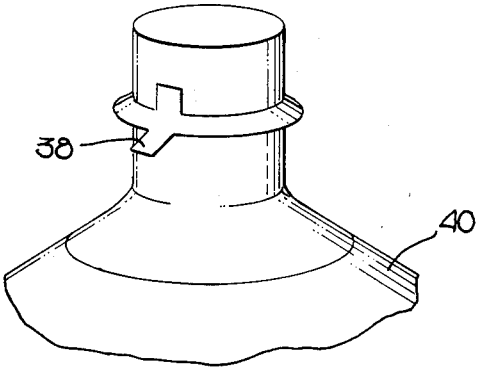
FIGS. 4*a* and 4*b* are top and perspective views, respectively, of a container with a pull-top type seal formed in accordance with the present invention.
Figure 4A:
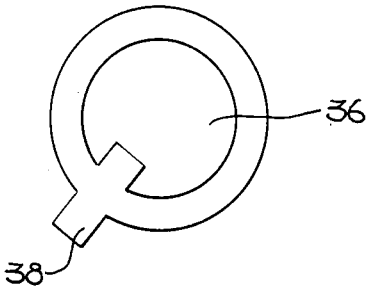

It is not necessary that the article to be covered contain any type of bead or rim about its top in order to effectuate a tight, durable seal. In addition, the method may be used to cover an article or articles of virtually any shape or size. One potentially very useful application of the method is shown in FIGS. 4*a* and 4*b*. By heating a portion 36 of the covering material, as shown in FIG. 4*a*, while selectively leaving an unheated tab portion 38, a pull-top type cover may be produced. After the material has been heated, as in FIG. 4*a*, the forming process previously described in FIGS. 2 and 3 is then used to conform the heated material to the top of the article 40 to be covered. The result in FIG. 4*b* is a seal which contains a thick rim and tab portion 38, and a thinner cover over the top of the article. The portion 38 thus provides a pull top tab which allows the seal to be easily pulled off by applying an upward pressure to the tab 38. By varying the shapes of the heated surfaces, different types of tamper-proof and pull-top type seals may be easily produced, and the relative thickness of portions 36 and 38 may be adjusted.

As some examples of other applications, the design of the softened area might be adjusted to result in a cover with added strength (due to increased thickness) in selected areas, or with ultra thin areas to readily fracture if the cover were disturbed. Also, such covers may be applied over sharp edges, or about threaded areas, or upon articles with irregular shapes and configurations. Caps and other structures can be applied over such covers if desired. Selected perforations can be provided in the cover for various purposes, such as to facilitate removal of the article from the carrier, or the cover from the article, or to permit interior pressure to be released. In short, the present method and cover offers exceedingly great flexibility in its uses and applications. The foregoing only suggest some of such uses and applications; many others will be readily apparent to those skilled in this field.

Figure 5:
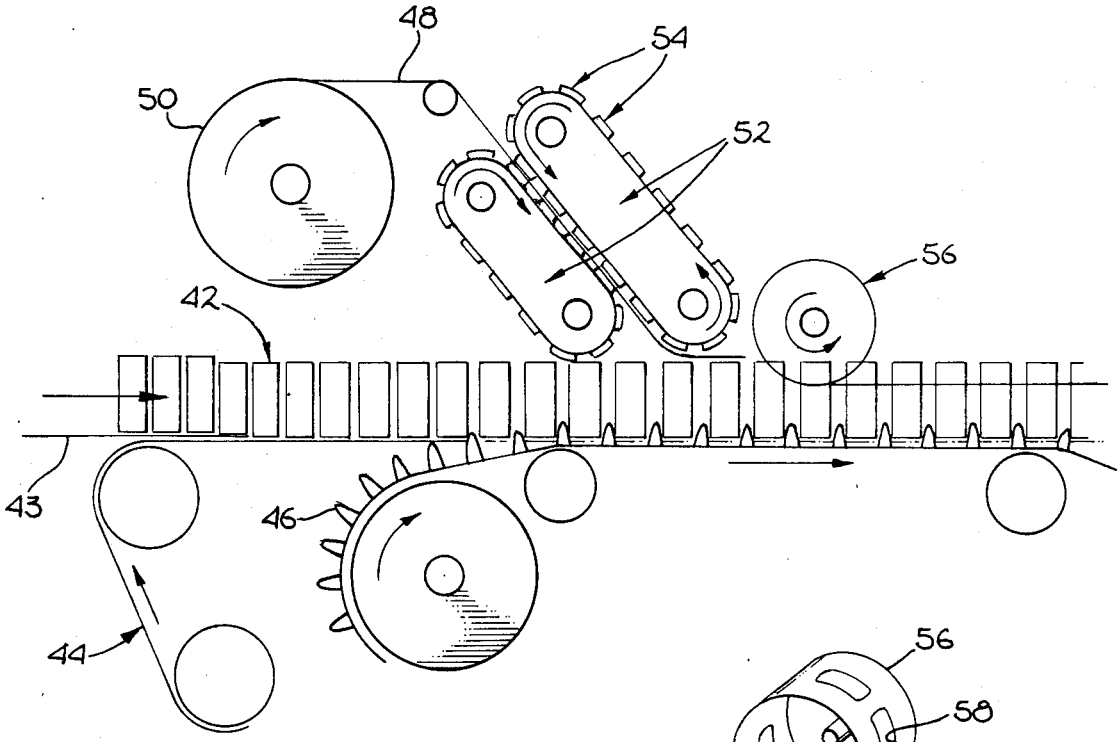
FIG. 5 is a plan view of a machine which may be used to make the carrier.
Figure 6:
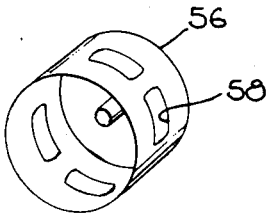
FIG. 6 is a perspective view of a component of the machine shown in FIG. 5.

In FIG. 5, the major elements of a machine are shown; the machine being used to rapidly seal a number of articles employing the previously described method. A line of articles 42 are brought to the machine by a simple transfer conveyor 43 of conventional design. The articles are transferred to a special in-feed conveyor 44 which contains gaps or holes to allow for an indexing mechanism 46 to engage and position the articles 42 in a manner which will align them with the softened areas of the plastic material and with the forming device. The plastic covering material 48 is fed to the machine from a supply roll 50. The material 48 enters the heating station or segment of the machine 52 where areas of the material 48 are selectively brought to forming temperature through contact with temperature controlled platens 54 on opposing belts. The material then passes over the articles or objects 42 and under the forming device 56 (shown in perspective in FIG. 6). As the forming device rolls over the articles 42, it presses sheet 48 down about the articles and the softened areas stretch over the top portions, thereby forming the sheet into a cover or carrier. The forming device 56 consists of a cylindrical wheel with elliptical shaped openings 58. Of course, if multiple lines of adjacent articles are to be simultaneously covered, forming device 56 would include multiple circumferential bands having openings 58. After the objects leave the forming section of the machine, they are held in a continuous web provided by material 48. The packages can then be divided into appropriate multiples, as desired, using conventional, well-known mechanisms.

In summary, the present invention provides a simple, ecnomical method for creating seals and covers as well as carriers for a single article or a group of articles. The method disclosed allows great latitude in the design of the particular seal, cover and machine since the softened area can have virtually any shape and since the softening process need not be carried out in proximity to the articles to be covered, and the forming device need not conform to the shapes of the tops of the articles to be covered. Variations in the disclosed covers, structures and methods will be apparent to those skilled in this art from the teachings presented herein. Accordingly, the scope of the invention is defined by the following claims.

What is claimed is:

1. A method of forming a cover for at least one article, said article having a top surface and a side wall surface, the cover comprising a sheet of material which is stretchable when softened but otherwise relatively rigid, the method utilizing a forming element which defines an opening substantially larger than the top surface of the article, the method comprising the steps of:

softening a well-defined, predetermined portion of said sheet, the softened portion being other than the same shape and being other than slightly larger than the size of the top surface, and further being substantially smaller than the size of the forming element opening, the softening step leaving a non-softened portion of said sheet around said softened portion; and engaging the nonsoftened portion of said sheet with said forming element wherein the softened portion of the sheet is within the forming element opening, said forming element engaging the non-softened portion sufficiently to thereby cause the softened portion of the sheet to stretch and conform about the article thereby forming a closely fitting cover;

wherein the forming force exerted on the softened portion is transmitted from the forming element by the nonsoftened portion.

2. A method of forming a cover for at least one article as set forth in claim 1 in which the softened portion is smaller in area than the top surface area of said article.

3. A method of forming a cover for at least one article as set forth in claim 1 in which the softened portion is equal in area to the top surface area of said article.

4. A method of forming a cover as set forth in claim 1 in which the softened portion includes at least one unsoftened portion projecting into the softened portion and providing a relatively rigid, stiff tab portion adjacent the article.

5. A method of forming a cover as set forth in claim 1 in which the sheet is softened at a first location, then, at a second location, forced over the top surface of the article.

6. A method of forming a cover for a plurality of articles as set forth in claim 1 in which a plurality of separate portions of the sheet are softened, the sheet then being forced about a plurality of articles, each softened portion of the sheet stretching and conforming about the top surface and a portion of the side wall surface of one article, thereby forming an assembly of closely fitting covers for a plurality of articles.

7. A method of forming a cover as set forth in claim 6 in which the sheet is sufficient|y stiff and rigid, relative to the weight of the articles, to permit the sheet to be used as a carrier or package for the articles.

8. A method of forming a cover as set forth in claim 7 in which the sheet is softened at the first location and forced about the plurality of articles at a second location.

9. A cover for an article, said cover being formed by the method set forth in claim 1.

10. A cover for an article, said cover being formed by the method set forth in claim 4.

11. A cover for a plurality of articles, the cover being formed by the method set forth in claim 6.

12. A cover for a plurality of articles, the cover being formed by the method set forth in claim 8.

13. A method of forming a cover as set forth in claim 1 in which the sheet is softened by a heated platen in the well-defined, predetermined shape and size of the portion of the sheet desired to be softened, the platen being moved to a position adjacent to the sheet to heat print the sheet and soften its desired portion of the sheet.

14. A method of forming a cover for at least one article, said article having a top surface and a side wall surface, the cover comprising a sheet of material which is stretchable when softened but otherwise relatively rigid, the method utilizing a forming element which defines an opening substantially larger than the top surface of the article, the method comprising the steps of:

softening a well-defined, predetermined portion of said sheet, the softened portion being the same size as the top surface, and further being substantially smaller than the size of the forming element opening, the softening step leaving a nonsoftened portion of said sheet around said softened portion; and engaging the nonsoftened portion of said sheet with said forming element wherein the softened portion of the sheet is within the forming element opening, said forming element engaging the nonsoftened portion sufficiently to thereby cause the softened portion of the sheet to stretch and conform about the article thereby forming a closely fitting cover;

wherein the forming force exerted on the softened portion is transmitted from the forming element by the nonsoftened portion.

15. A method of forming a cover for at least one article, said article having a top surface and a side wall surface, the cover comprising a sheet of material which is stretchable when softened but otherwise relatively rigid, the method utilizing a forming element which defines an opening substantially larger than the top surface of the article, the method comprising the steps of:

softening a well-defined, predetermined portion of said sheet, the softened portion being smaller than the size of the top surface, and further being substantially smaller than the size of the forming element opening, the softening step leaving a nonsoftened portion of said sheet around said softened portion; and engaging the nonsoftened portion of said sheet with said forming element wherein the softened portion of the sheet is within the forming element opening, said forming element engaging the nonsoftened portion sufficiently to thereby cause the softened portion of the sheet to stretch and conform about the article thereby forming a closely fitting cover;

wherein the forming force exerted on the softened portion is transmitted from the forming element by the nonsoftened portion.

* * * * *